US009254547B2

(12) United States Patent
Yuan et al.

(10) Patent No.: US 9,254,547 B2
(45) Date of Patent: Feb. 9, 2016

(54) SIDE PAD DESIGN FOR EDGE PEDESTAL

(75) Inventors: Yin Yuan, Sunnyvale, CA (US); Hung Chih Chen, Sunnyvale, CA (US); Shou-Sung Chang, Stanford, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 1500 days.

(21) Appl. No.: 12/751,743

(22) Filed: Mar. 31, 2010

(65) Prior Publication Data

US 2011/0244763 A1 Oct. 6, 2011

(51) Int. Cl.

| | |
|---|---|
| ***B24B 53/017*** | (2012.01) |
| ***B24B 37/005*** | (2012.01) |
| ***B24B 37/10*** | (2012.01) |
| ***B24B 37/34*** | (2012.01) |

(52) U.S. Cl.

CPC ..... *B24B 53/017* (2013.01); *B24B 37/005* (2013.01); *B24B 37/10* (2013.01)

(58) Field of Classification Search

CPC ..... B24B 1/00; B24B 37/005; B24B 37/04; B24B 37/043; B24B 37/10; B24B 37/34; B24B 37/345; B24B 53/005; B24B 53/017; B24B 53/12

USPC ..... 451/54, 56, 443, 5, 6, 41, 285, 287

See application file for complete search history.

(56) References Cited

U.S. PATENT DOCUMENTS

| | | | | |
|---|---|---|---|---|
| 5,921,855 | A * | 7/1999 | Osterheld et al. | 451/527 |
| 6,361,420 | B1 | 3/2002 | Zuniga et al. | |
| 6,379,230 | B1 | 4/2002 | Hayashi et al. | |
| 6,399,501 | B2 * | 6/2002 | Birang et al. | 438/692 |
| 6,428,386 | B1 * | 8/2002 | Bartlett | 451/6 |
| 6,432,823 | B1 * | 8/2002 | Huynh et al. | 438/690 |
| 7,134,944 | B2 * | 11/2006 | Taylor | 451/56 |
| 7,182,669 | B2 * | 2/2007 | Elledge | 451/6 |
| 7,210,984 | B2 * | 5/2007 | Taylor | 451/44 |
| 7,967,660 | B2 * | 6/2011 | Fukuda et al. | 451/5 |
| 7,967,661 | B2 * | 6/2011 | Taylor et al. | 451/6 |
| 7,976,358 | B2 * | 7/2011 | Fukuda et al. | 451/5 |
| 8,002,607 | B2 * | 8/2011 | Fukuda et al. | 451/5 |
| 2003/0092269 | A1 | 5/2003 | Parikh | |
| 2005/0090105 | A1 * | 4/2005 | Elledge | 438/689 |
| 2007/0238399 | A1 | 10/2007 | Tolles et al. | |
| 2007/0275637 | A1 * | 11/2007 | Elledge | 451/8 |
| 2008/0057836 | A1 | 3/2008 | Polyak et al. | |
| 2008/0311834 | A1 | 12/2008 | Lafon et al. | |
| 2009/0036036 | A1 | 2/2009 | Nangoy et al. | |
| 2009/0239446 | A1 * | 9/2009 | Fukuda et al. | 451/5 |
| 2009/0318061 | A1 * | 12/2009 | Taylor et al. | 451/6 |

FOREIGN PATENT DOCUMENTS

| | | | |
|---|---|---|---|
| KR | 20050114529 | A | 12/2005 |
| KR | 20060030257 | A | 4/2006 |

OTHER PUBLICATIONS

International Search Report and Written Opinion Dated Sep. 26, 2011 for International Application No. PCT/US2011/024241.

* cited by examiner

*Primary Examiner* — Eileen Morgan

(74) *Attorney, Agent, or Firm* — Patterson & Sheridan, LLP

(57) ABSTRACT

A method and apparatus for facilitating equalized conditioning of a polishing surface of a polishing pad is described. The apparatus includes an extension device coupled to a base adjacent a peripheral edge of a polishing pad that is adapted to support a conditioning device, the extension device includes a body that is movable relative to the polishing pad, and a sacrificial pad comprising a polishing material coupled to a mounting surface of the body.

22 Claims, 7 Drawing Sheets

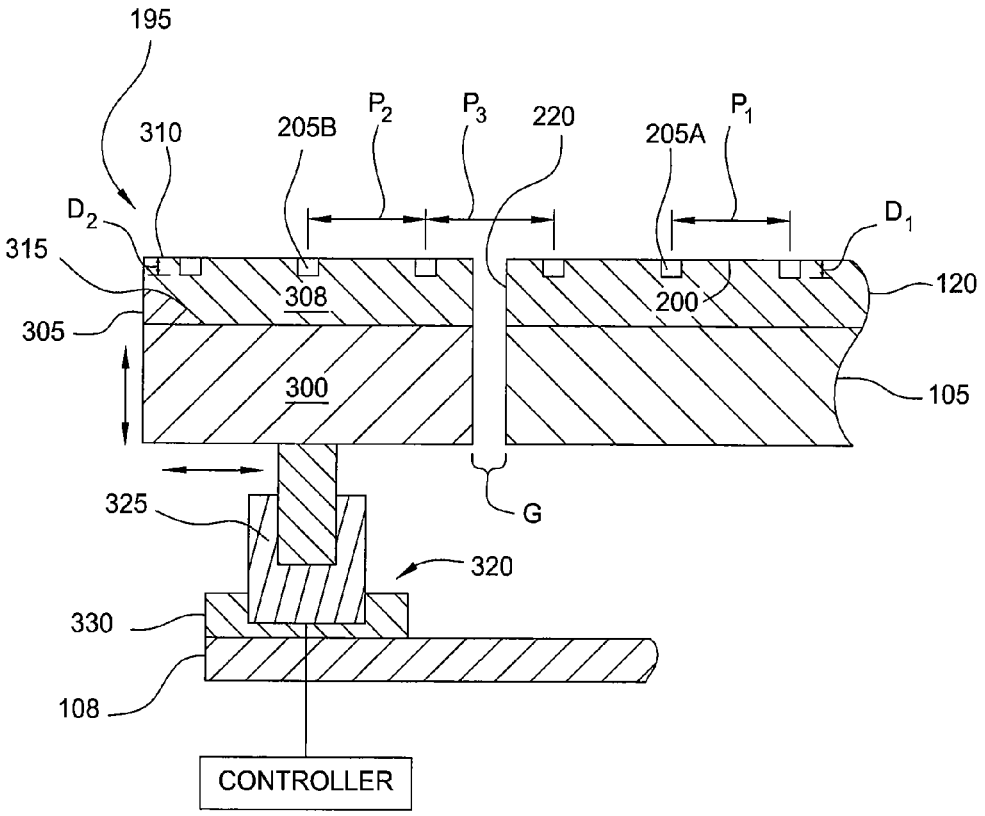
FIG. 3
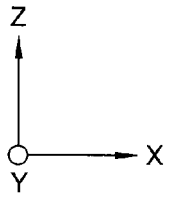

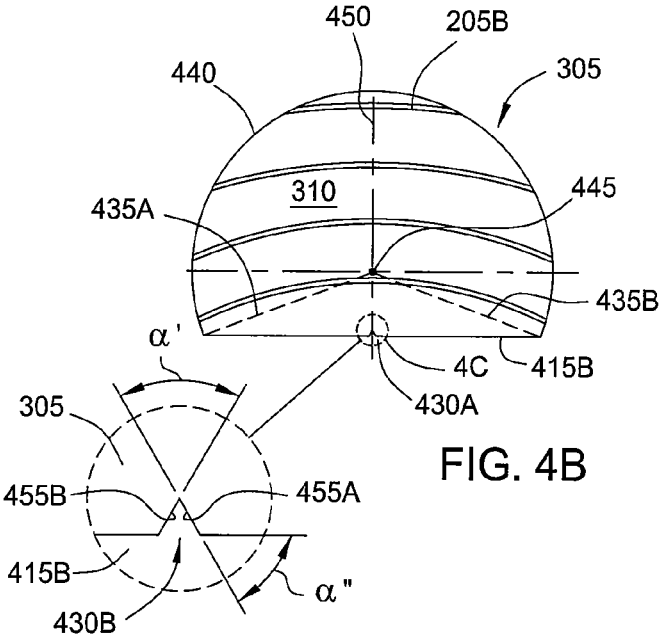
FIG. 4B
FIG. 4C
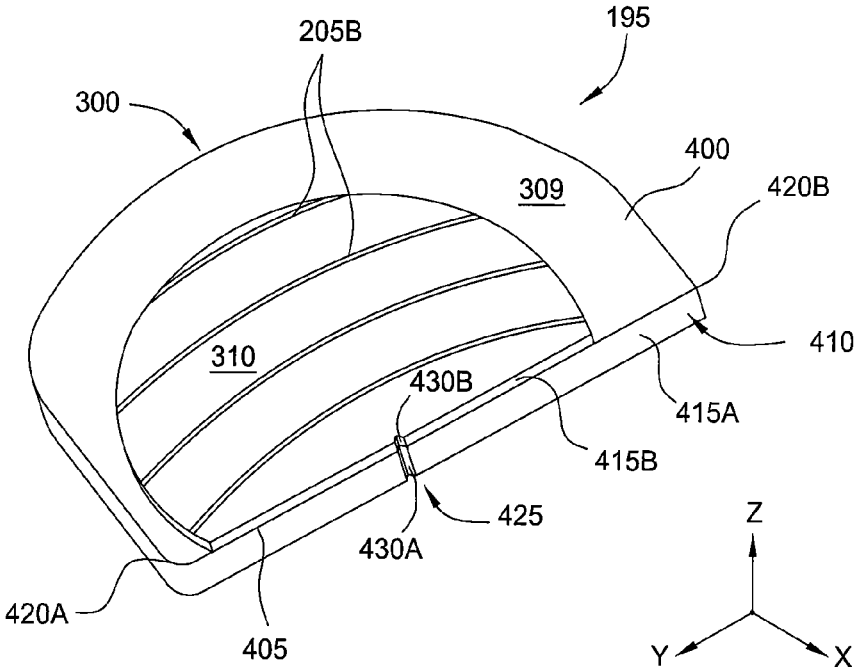
FIG. 4A

SIDE PAD DESIGN FOR EDGE PEDESTAL

BACKGROUND OF THE INVENTION

1. Field of the Invention

Embodiments of the present invention generally relate to polishing a substrate, such as a semiconductor wafer.

2. Description of the Related Art

In the fabrication of integrated circuits and other electronic devices on substrates, multiple layers of conductive, semiconductive, and dielectric materials are deposited on or removed from a feature side, i.e., a deposit receiving surface, of a substrate. As layers of materials are sequentially deposited and removed, the feature side of the substrate may become non-planar and require planarization and/or polishing. Planarization and polishing are procedures where previously deposited material is removed from the feature side of the substrate to form a generally even, planar or level surface. The procedures are useful in removing undesired surface topography and surface defects, such as rough surfaces, agglomerated materials, crystal lattice damage, and scratches. The procedures are also useful in forming features on a substrate by removing excess deposited material used to fill the features and to provide an even or level surface for subsequent deposition and processing.

Chemical mechanical polishing is one process commonly used in the manufacture of high-density integrated circuits to planarize or polish a layer of material deposited on a semiconductor wafer by moving the feature side of the substrate in contact with a polishing pad while in the presence of a polishing fluid. Material is removed from the feature side of the substrate that is in contact with the polishing surface through a combination of chemical and mechanical activity.

Periodic conditioning of the polishing surface is required to maintain a consistent roughness and/or a generally flat profile across the polishing surface. The conditioning is typically performed using a rotating conditioning disk that is urged against the polishing surface while being swept across the majority of the pad surface. However, the conditioning disk may not be utilized effectively on the outer peripheral edge of the pad surface as the disk may cut into the pad and cause a condition known as "edge balding," where the peripheral edge of the pad is worn away prematurely. Likewise, the peripheral edge of the pad may not be utilized for polishing as the peripheral edge of the pad is not conditioned to the same degree as portions of the pad interior of the peripheral edge.

Therefore, there is a need for a method and apparatus that facilitates equalized conditioning of the polishing surface and enables global utilization of the polishing surface of the pad.

SUMMARY OF THE INVENTION

A method and apparatus for facilitating equalized conditioning of a polishing surface of a polishing pad is described. In one embodiment, an apparatus is described. The apparatus includes a base having a rotatable polishing pad coupled to an upper surface thereof, the polishing pad having a polishing surface and a peripheral edge, a conditioning device adapted to move relative to the polishing surface in a sweep pattern that extends beyond the peripheral edge, and an extension device coupled to the base adjacent the peripheral edge of the polishing pad and adapted to support the conditioning device when the conditioning device in at least a portion of the sweep pattern. The extension device comprises a body that is movable relative to the polishing pad, and a sacrificial pad comprising a polishing material coupled to a mounting surface of the body, wherein one or both of the body and sacrificial pad includes an indexing feature.

In another embodiment, an apparatus is described. The apparatus includes a base having a rotatable platen and a circular polishing pad coupled to an upper surface thereof, the polishing pad having a polishing surface and a circumferential edge, a conditioning device having an abrasive surface adapted to move relative to the polishing surface in a sweep pattern that extends beyond the circumferential edge, and an extension device coupled to the base adjacent the circumferential edge of the polishing pad and adapted to support the conditioning device when the conditioning device in at least a portion of the sweep pattern. The extension device comprises a body that is movable relative to the polishing pad, the body having an interface surface facing the circumferential edge of the polishing pad, a sacrificial pad comprising a polishing material coupled to a mounting surface of the body, the sacrificial pad having a surface area that is less than the abrasive surface of the conditioning device, and an indexing feature disposed on one or both of the body and the sacrificial pad to facilitate alignment of the sacrificial pad and the mounting surface.

In another embodiment, a method for conditioning a polishing pad is described. The method includes urging a conditioning disk against a polishing surface of a rotating polishing pad, the conditioning disk having an abrasive contact surface with a first surface area, and moving the conditioning disk while in contact with the polishing surface in a sweep pattern that extends beyond a peripheral edge of the polishing pad and at least partially onto a sacrificial pad adjacent the peripheral edge of the polishing pad, the sacrificial pad having a second surface area that is less than the first surface area of the conditioning disk.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 is a cross-sectional view of a portion of the polishing pad and the polishing surface extension device of FIG. 2.

FIG. 4A is an isometric view of one embodiment of a polishing surface extension device.

FIG. 4B is a top plan view of one embodiment of a sacrificial pad.

FIG. 4C is a magnified view of the sacrificial pad of FIG. 4B.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
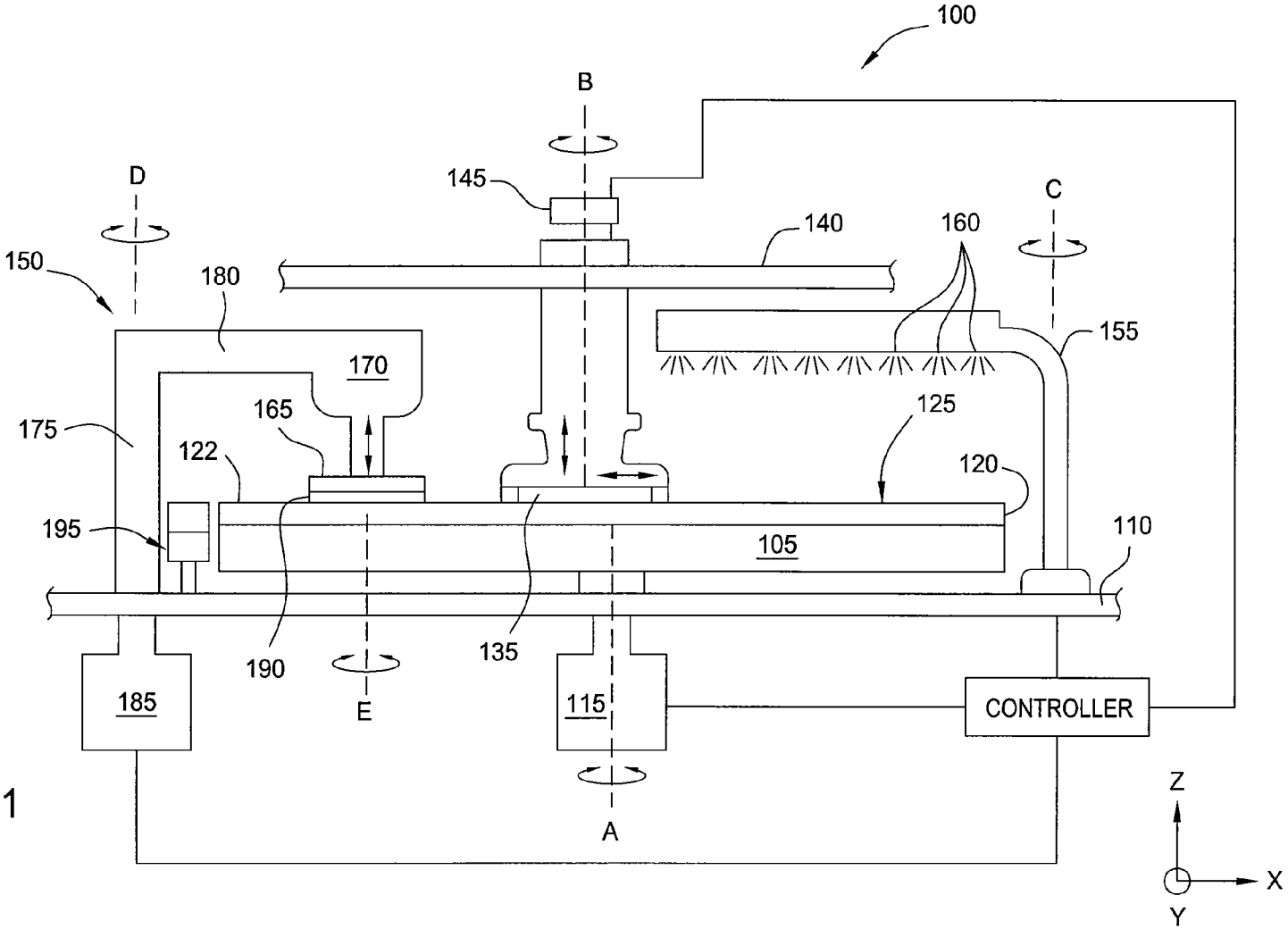
FIG. 1 is a partial sectional view of one embodiment of a processing station that is configured to perform a polishing process.

FIG. 1 is a partial sectional view of one embodiment of a processing station 100 that is configured to perform a polishing process, such as a chemical mechanical polishing (CMP) process or an electrochemical mechanical polishing (ECMP) process. The processing station 100 may be a stand-alone unit or part of a larger processing system. Examples of a larger processing system that the processing station 100 may be utilized with include REFLEXION®, REFLEXION® LK, REFLEXION® LK ECMP™, MIRRA MESA® polishing systems available from Applied Materials, Inc., located in Santa Clara, Calif., although other polishing systems may be utilized. Other polishing modules, including those that use other types of processing pads, belts, indexable web-type pads, or a combination thereof, and those that move a substrate relative to a polishing surface in a rotational, linear or other planar motion may also be adapted to benefit from embodiments described herein.

The processing station 100 includes a platen 105 rotatably supported on a base 110. The platen 105 is operably coupled to a drive motor 115 adapted to rotate the platen 105 about a rotational axis A. The platen 105 supports a polishing pad 120 made of a polishing material 122. In one embodiment, the polishing material 122 of the polishing pad 120 is a commercially available pad material, such as polymer based pad materials typically utilized in CMP processes. The polymer material may be a polyurethane, a polycarbonate, fluoropolymers, PTFE, PTFA, polyphenylene sulfide (PPS), or combinations thereof. The polishing material 122 may further comprise open or closed cell foamed polymers, elastomers, felt, impregnated felt, plastics, and like materials compatible with the processing chemistries. In another embodiment, the polishing material 122 is a felt material impregnated with a porous coating. It is contemplated that polishing pads having at least partially conductive polishing surfaces may also benefit from the invention.

In one embodiment, the polishing pad 120 comprises a processing surface 125 which includes a nap that may include microscopic pore structures. The nap and/or pore structures effect material removal from the feature side of a substrate. Attributes such as polishing compound retention, polishing or removal activity, and material and fluid transportation affect the removal rate. In order to facilitate optimal removal of material from the substrate, the processing surface 125 must be periodically conditioned to roughen and/or fully and evenly open the nap or pore structures. When the processing surface 125 is conditioned in this manner, the processing surface 125 provides a uniform and stable removal rate. The roughened processing surface 125 facilitates removal by enhancing pad surface wettability and dispersing polishing compounds, such as, for example, abrasive particles supplied from the polishing compound.

A carrier head 130 is disposed above the processing surface 125 of the polishing pad 120. The carrier head 130 retains a substrate 135 and controllably urges the substrate 135 towards the processing surface 125 (along the Z axis) of the polishing pad 120 during processing. The carrier head 130 is mounted to a support member 140 that supports the carrier head 130 and facilitates movement of the carrier head 130 relative to the polishing pad 120. The support member 140 may be coupled to the base 110 or mounted above the processing station 100 in a manner that suspends the carrier head 130 above the polishing pad 120. In one embodiment, the support member 140 is a circular track that is mounted above the processing station 100. The carrier head 130 is coupled to a drive system 145 that provides at least rotational movement of the carrier head 130 about a rotational axis B. The drive system 145 may additionally be configured to move the carrier head 130 along the support member 140 laterally (X and/or Y axes) relative to the polishing pad 120. In one embodiment, the drive system 145 moves the carrier head 130 vertically (Z axis) relative to the polishing pad 120 in addition to lateral movement. For example, the drive system 145 may be utilized to urge the substrate 135 towards the polishing pad 120 in addition to providing rotational and/or lateral movement of the substrate 135 relative to the polishing pad 120. The lateral movement of the carrier head 130 may be a linear or an arcing or sweeping motion.

A conditioning device 150 and a fluid applicator 155 are shown positioned over the processing surface 125 of the polishing pad 120. The fluid applicator 155 includes one or more nozzles 160 adapted to provide polishing fluids or a polishing compound to at least a portion of the radius of the polishing pad 226. The fluid applicator 155 is rotatably coupled to the base 110. In one embodiment, the fluid applicator 155 is adapted to rotate about a rotational axis C and provides a fluid that is directed toward the processing surface 125. The fluid may be a chemical solution, a cleaning solution, or a combination thereof. For example, the fluid may be an abrasive containing or abrasive free polishing compound adapted to aid in removal of material from the feature side of the substrate 135. Reductants and oxidizing agents such as hydrogen peroxide may also be added to the fluid. Alternatively, the fluid may be a rinsing agent, such as deionized water (DIW), which is used to rinse or flush polishing byproducts from the polishing material 122. In an alternative, the fluid may be used to facilitate conditioning of the processing surface 125 to open the microscopic pore structures of the polishing material 122.

The conditioning device 150 generally includes a conditioner carrier 165 coupled to a head assembly 170. The head assembly 170 is coupled to a support member 175 by an arm 180. The support member 175 is disposed through the base 110 of the processing station 100. Bearings (not shown) are provided between the base 110 and the support member 175 to facilitate rotation of the support member 175 about a rotational axis D relative to the base 110. An actuator 185 is coupled between the base 110 and the support member 175 to control the rotational orientation of the support member 175 about the rotational axis D to allow the head assembly 170 to move in an arc or sweeping motion across the processing surface 125 of the polishing pad 120. The support member 175 may house drive components to selectively rotate the conditioner carrier 165 relative to the polishing pad 120 about a rotational axis E. The support member 175 may also provide fluid conduits to control the vertical position (in the Z axis) of one of the conditioner carrier 165 or the head assembly 170.

A conditioning element 190 is coupled to the bottom surface of the conditioner carrier 165. The conditioner carrier 165 is coupled to the head assembly 170 and may be selectively pressed against the platen 105 while rotating about rotational axis E to condition the polishing material 122 with the conditioning element 190. The conditioning element 190 may be urged toward the polishing material 122 at a pressure or downforce of between about 0.1 pound-force to about 20 pound-force, for example, between about 3 pound force to about 11 pound force. The conditioning element 190 may be an abrasive disk, such as a diamond or ceramic material, which is configured to abrade and enhance the polishing material 122. Alternatively, the conditioning element 190 may be a brush-type conditioning disk, such as a disk having nylon bristles. The conditioning element 190 is typically circular or a disk that is configured for ease in replacement and attachment to the conditioning carrier 165.

The processing station 100 also includes a polishing surface extension device 195 positioned adjacent the perimeter of the polishing pad 120 and the platen 105. The polishing surface extension device 195 provides conditioning of the entire processing surface 125 of the polishing pad 120 by allowing the center of the conditioning element 190 to sweep to or beyond the perimeter of the polishing pad 226. The extension device 195 at least partially supports the conditioning element 190 as the conditioning element 190 sweeps to or beyond the perimeter of the polishing pad 226.

Figure 2:
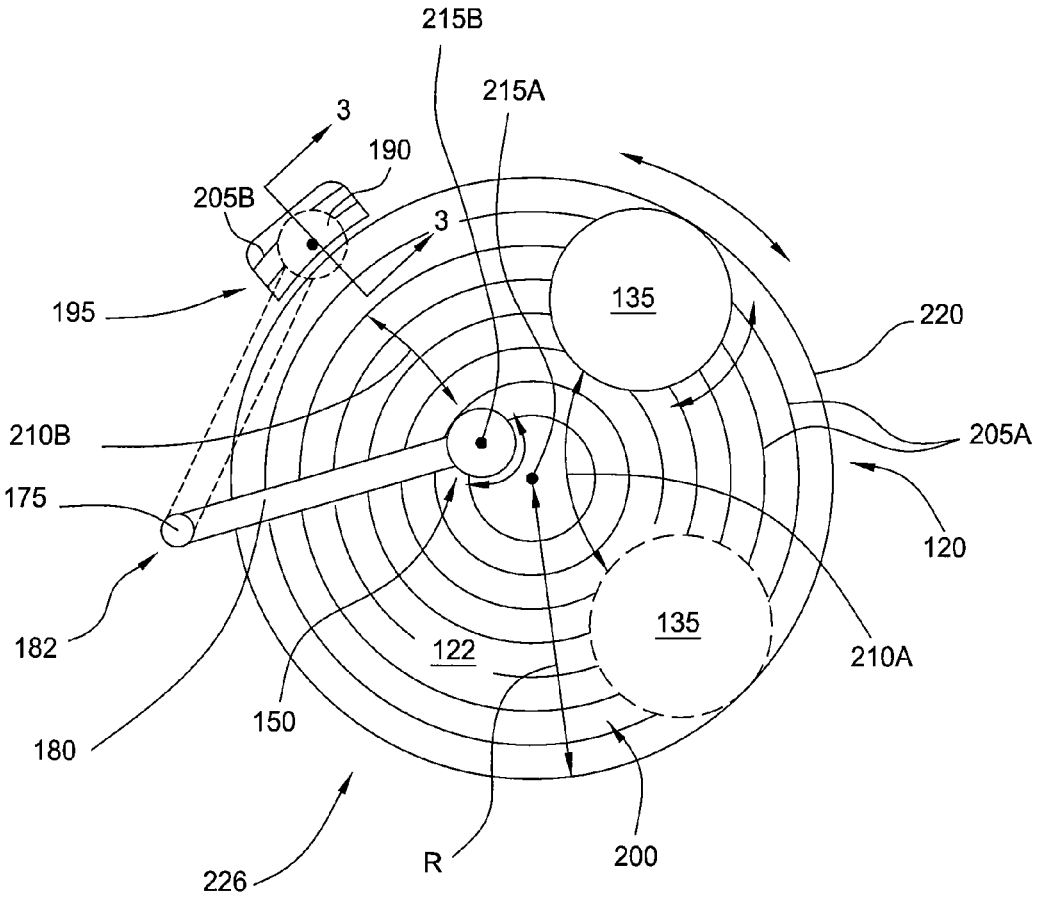
FIG. 2 is a top plan view of the processing station of FIG. 1.

FIG. 2 is a top plan view of the processing station 100 of FIG. 1. In one embodiment, the polishing pad 120 disposed in the processing station 100 includes a patterned processing surface 200 that facilitates removal of material from a substrate 135 and/or fluid transport during processing. The patterned processing surface 200 may include perforations, or grooves or channels formed in the polishing material 122 to a specific depth. The channels or grooves may be linear or curved, and may have a radial, grid, X/Y pattern, spiral or circular orientation on the polishing pad 120. The channels or grooves may be intersecting or non-intersecting. Alternatively or additionally, the polishing material 122 may be embossed. In this embodiment, the patterned processing surface 200 includes a plurality of concentric channels or grooves 205.

FIG. 2 also shows the substrate 135 disposed on the polishing material 122 of the polishing pad 120 (partially in phantom) to indicate one embodiment of a polishing sweep pattern 210A of the substrate 135 on the patterned processing surface 200 during polishing. The conditioning element 190 is shown partially in phantom to illustrate one embodiment of a conditioning sweep pattern 210B of the conditioning element 190 on the patterned processing surface 200. The conditioning element 190 is swept across the processing surface 125 to condition and/or refresh the patterned processing surface 200 to facilitate an enhanced removal rate of material from the substrate 135.

In this embodiment, the polishing pad 120 is circular and includes a radius R from a geometric center 215A of the polishing pad 120 to the edge 220 of the polishing pad 120. Conventional CMP conditioning apparatus generally do not condition uniformly across the entire radius or surface of the pad as the conditioning element tends to wear the polishing pad more aggressively at or near the outer diameter. The increased wear at or near the outer diameter of the polishing pad creates what is known as "edge balding," which makes portions of the outer diameter of the polishing pad undesirable for polishing processes. In addition, the increased wear at or near the outer diameter of the polishing pad decreases the lifetime of the polishing pad, which necessitates more frequent replacement and increases downtime as well as cost of ownership.

The polishing surface extension device 195 enables at least a portion of the conditioning element 190 to be swept beyond an edge 220 of the polishing pad 120. The edge 220 may be a peripheral edge or a circumferential edge in the case of a circular polishing pad 120. In one embodiment, the extension device 195 is large enough such that a center 215B of the conditioning element 190 may sweep beyond the edge 220 of the polishing pad 120. As the center 215B of the conditioning element 190 is at or near the edge 220, the conditioning element 190 remains fully supported (i.e., completely on top of) by a combination of the polishing pad 120 and the extension device 195.

FIG. 3 is a cross-sectional view of a portion of the polishing pad 120 and the polishing surface extension device 195 of FIG. 2. The extension device 195 is disposed on a support member 300 that is movable relative to the edge 220 of the polishing pad 120. The support member 300 supports a replaceable sacrificial pad 305. In one embodiment, the support member 300 is adjustable and may be selectively fixed relative to the polishing pad 120. In this embodiment, the support member 300 may be adjusted vertically (Z axis) and horizontally (X and/or Y axes) relative to the horizontal plane of the processing surface 200 and/or the edge 220.

When a new polishing pad 120 is installed on the platen 105 and/or a new sacrificial pad 305 is installed on the support member 300 of the polishing surface extension device 195, the plane or height of the processing surface 310 of sacrificial pad 305 may be matched with the plane or height defined by the processing surface 125 of the polishing pad 226. The height of the processing surface 310 may be determined by a straight edge or gauge relative to the plane of the processing surface 125 of the polishing pad 226. In one embodiment, the height is set by extending the lower surface of the conditioning element 190 over the edge 220 of the polishing pad 120. The contact surface of the conditioning element 190 is maintained to be in contact and coplanar with the processing surface 125 of the polishing pad 120 and the support member 300 may be adjusted so that the processing surface 310 of the sacrificial pad 305 contacts the contact surface of the conditioning element 190. Once the support member 300 is adjusted, the support member 300 is then fixed relative to the polishing pad 120 during a polishing process and/or a conditioning process. Adjustments to the support member 300 may be made manually by personnel or with the use of drives.

In one embodiment, the support member 300 is coupled to the base 108 of the processing station 100. The extension device 195 includes or is coupled to a drive system 320 adapted to adjust the position of the support member 300 at least in the X direction and Z direction. A small gap G between the peripheral edge 220 of the polishing pad 120 may be provided to allow for rotational movement of the polishing pad 120 without interference from the extension device 195. The gap G may be between about 3 mm to about 20 mm, or greater.

In one embodiment, the drive system 320 includes an actuator 325 adapted to move the support member 300 laterally (X and/or Y axes) and/or vertically (Z axis) relative to the polishing pad 120 and/or platen 105. In one embodiment, the actuator 325 is a pneumatic motor with a brake adapted to move the support member 300 laterally and/or vertically relative to the polishing pad 120 and/or the platen 105. The actuator 325 may be coupled to a drive platform 330 that may in turn be coupled to the base 108 by fasteners that may be loosened to adjust the drive platform 330 relative to the base 108, which moves the support member 300 relative to the polishing pad 120 and/or platen 105. In another embodiment, lateral adjustment of the support member 300 is done manually and the adjustment is provided by one or more fasteners, such as set screws or bolts, either concentrically or eccentrically. Additionally or alternatively, the actuator 325 may be a hydraulic cylinder, a lead screw, or other mechanical or electromechanical drives.

The sacrificial pad 305 comprising a polishing material 308 is supported on an upper surface 315 of the support member 300. In one embodiment, the polishing material 308 is made of the same material as the polishing material 122 as described above. In another embodiment, the sacrificial pad 305 may be a material having a hardness that is greater than the polishing material 122 as described above. In another embodiment, the sacrificial pad 305 may be a sacrificial material or a bearing surface. The sacrificial pad 305 is adhered or otherwise removably coupled to the upper surface 315 of the support member 300 in a manner that allows replacement of the sacrificial pad 305.

In this embodiment, the processing surface 200 of the polishing pad 120 includes a first set of one or more first grooves 205A and the processing surface 310 of the sacrificial pad 305 includes a patterned processing surface that may be configured in another pattern that is different than the pattern on the processing surface 200 of the polishing pad 120. Examples of patterns on the processing surface 310 include perforations, or grooves or channels. The channels or grooves may be formed in a linear or curved pattern, or a radial pattern, a grid, an X/Y pattern, or a spiral or circular orientation on the processing surface 310. In one embodiment, the processing surface 310 includes a second set of one or more second grooves 205B. The grooves 205A include a depth $D_1$ as measured from the upper surface of the processing surface 200 to a bottom of the groove 205A. In one example, the depth $D_1$ of the grooves 205A are about 30 mils deep when the polishing pad 120 is new. In one embodiment, the grooves 205B include a depth $D_2$ that may be substantially equal to the depth $D_1$ of the grooves 205A. At least a portion of the grooves 205A will experience a decrease in the depth $D_1$ due to loss of material from conditioning and/or polishing processes. During a conditioning and/or polishing process, polishing material 122 and/or polishing material 308 is worn away from the contact surface of the conditioning element 190, which decreases the depth $D_1$ and/or depth $D_2$.

In one embodiment, the grooves 205A of the polishing pad 120 include a pitch $P_1$ between about 30 mils to about 80 mils, for example, about 50 mils. In this embodiment, the grooves 205B on the sacrificial pad 305 include a pitch $P_2$ that may be substantially the same as the pitch $P_1$ of the grooves 205A. In some embodiments, positioning of the extension device 195 provides a pitch $P_3$ between the grooves 205A of the polishing pad 120 and the grooves 205B of the sacrificial pad 305. The pitch $P_3$ may be lesser or greater than one or both of the pitch $P_1$ and the pitch $P_2$. In one embodiment, the pitch $P_3$ is substantially equal to one or both of the pitch $P_1$ and the pitch $P_2$.

FIG. 4A is an isometric view of one embodiment of the polishing surface extension device 195. The extension device 195 includes the support member 300 having the sacrificial pad 305 disposed thereon. In this embodiment, the support member 300 comprises a body 400 having the sacrificial pad 305 coupled thereto by an adhesive 405. In one embodiment, the body 400 includes a mounting surface 309 with a surface area greater than the surface area of the sacrificial pad 305. The adhesive 405 may be a temperature and/or pressure sensitive adhesive adapted to withstand process chemistry. In this embodiment, the extension device 195 includes an interface surface 410 defined between a first end 420A and a second end 420B of the extension device 195. The interface surface 410 is configured to face the platen 105 and the edge 220 of the polishing pad 120 (FIGS. 2 and 3) during operation. The interface surface 410 comprises an edge 415A of the body 400 and an edge 415B of the sacrificial pad 305. In one embodiment, the interface surface 410 is curved on a constant radius between the first end 420A and the second end 420B. In one aspect, the radius defining the interface surface 410 is substantially equal to or slightly greater than the radius of the platen 105 and/or the polishing pad 120 (not shown). For example, if a polishing pad included a 30 inch diameter, then the interface surface 410 would have a concave shape defined by about a 15 inch radius, or greater radius. In another embodiment, the interface surface 410 may be flat or planar.

In one embodiment, the extension device 195 includes an indexing feature 425 adapted to facilitate alignment of the sacrificial pad 305 with the support member 300. The indexing feature 425 may be a mark on the interface surface 410 or a depression or channel formed in the interface surface 410. In one embodiment, the indexing feature 425 comprises a channel 430A formed in the body 400 and/or a channel 430B formed in the sacrificial pad 305.

FIG. 4B is a top plan view of one embodiment of the sacrificial pad 305. In one embodiment, the sacrificial pad 305 comprises a circular sector or a portion of a circle defined by an arc 440 having a central radius 450. In one aspect, the sacrificial pad 305 comprises a circular body bounded by the arc 440 and the edge 415B comprises a chord that is offset from a center 445 of the arc 440 and/or intersects the arc 440 at two radii 435A, 435B. The center 445 and/or the central radius 450 of the sacrificial pad 305 may be aligned with a radius of a polishing pad 120 (shown in FIGS. 1 and 2) during installation and/or use.

In one embodiment, the diameter or surface area of the sacrificial pad 305 is related to the diameter or surface area of the conditioning element 190 (FIGS. 1 and 2). For example, with a disk shaped conditioning element 190, the diameter or surface area refers to the diameter or surface area of the conditioning surface of the conditioning element 190 (i.e., the portion of the conditioning element 190 that contacts the polishing material 122). In one embodiment, the surface area of the sacrificial pad 305 is smaller than the surface area of the conditioning surface of the conditioning element 190 that is utilized. For example, the surface area of the sacrificial pad 305 is less than a surface area of the conditioning element 190. In one aspect, the radius of the sacrificial pad 305 (e.g. radius 450) is less than 100% of the radius of the conditioning surface of the conditioning element 190. In another aspect, the radius of the sacrificial pad 305 (e.g. radius 450) is less than about 75% of the radius of the conditioning surface of the conditioning element 190. For example, the radius of the sacrificial pad 305 (e.g. radius 450) is between about 80% to about 98% of the radius of the conditioning surface of the conditioning element 190.

In a specific example, if the diameter of the conditioning surface of the conditioning element 190 is about 4.0 inches to about 4.25 inches, the radius (e.g. radius 450) of the sacrificial pad 305 is about 1.9 inches to about 1.5 inches, such as about 1.8 inches when the conditioning surface of the conditioning element 190 is about 4.0 inches.

The inventors have discovered that the relation between the surface area of the sacrificial pad 305 and the surface area of the conditioning surface of the conditioning element 190 extends pad lifetime. One consideration involves factors such as angular velocity of the platen 105, angular and/or linear velocity of the conditioning element 190, and downforce of the conditioning element 190 affect wear of the polishing pad 120 during conditioning. If angular velocity of the platen 105, angular and/or linear velocity of the conditioning element 190, and downforce of the conditioning element 190 remain the same during conditioning, wear at the edge 220 of the polishing pad 120 is greater relative to wear at the center 215 of the polishing pad 120. The greater wear of the edge 220 of the polishing pad 120 may be mitigated by complicated adjustments in one or a combination of angular velocity of the platen 105, angular and/or linear velocity of the conditioning element 190, and downforce of the conditioning element 190 as the conditioning element 190 moves in the conditioning sweep pattern 210B (FIG. 2). The inventors have discovered that angular velocity of the platen 105, angular and/or linear velocity of the conditioning element 190, and downforce of the conditioning element 190 may remain constant during the conditioning sweep pattern 210B using the embodiments of the sacrificial pad 305 as described herein. Utilizing a sacrificial pad 305 having a surface area that is less than the surface area of the conditioning surface of the conditioning element 190 equalizes relative velocity of the conditioning element 190 as the platen 105 rotates. Therefore, equalized relative velocity of the conditioning element substantially equalizes conditioning of the processing surface 125 without adjustments to one or a combination of angular velocity of the platen 105, angular and/or linear velocity of the conditioning element 190, and downforce of the conditioning element 190. Another consideration involves the construction of the conditioning surface of the conditioning element 190. In one aspect, the conditioning surface of the conditioning element 190 may include a center surface area that includes abrasives and an outer surface area or perimeter that does not include abrasives. For example, about 90% of the conditioning surface of the conditioning element 190 includes abrasives, such as diamond structures that are configured to abrade the processing surface 125 of the polishing pad 120 while the outer perimeter (e.g., about 10%) of the conditioning surface of the conditioning element 190 does not abrade the processing surface 125 of the polishing pad 120. Thus, the abrasive distribution on the conditioning surface of the conditioning element may relate to the configuration (e.g., size, spacing or adjustment) of the sacrificial pad 305 and/or the extension device 195.

FIG. 4C is a magnified view of the sacrificial pad 305 of FIG. 4B to show details of the channel 430B. In one aspect, the channel 430B includes at least one sidewall, such as sidewalls 455A and 455B. The sidewalls 455A, 455B are sloped or directed toward the center 445 of the sacrificial pad 305. In one embodiment, the sidewalls 455A and 455B are sloped inwardly at an angle α' and/or an angle α" off normal or relative to the edge 415B. In one aspect, at least one of the angle α' or angle α" is between about 30 degrees to about 75 degrees, such as about 60 degrees. In one embodiment, both of angle α' and angle α" are substantially equal.

Figure 4D:
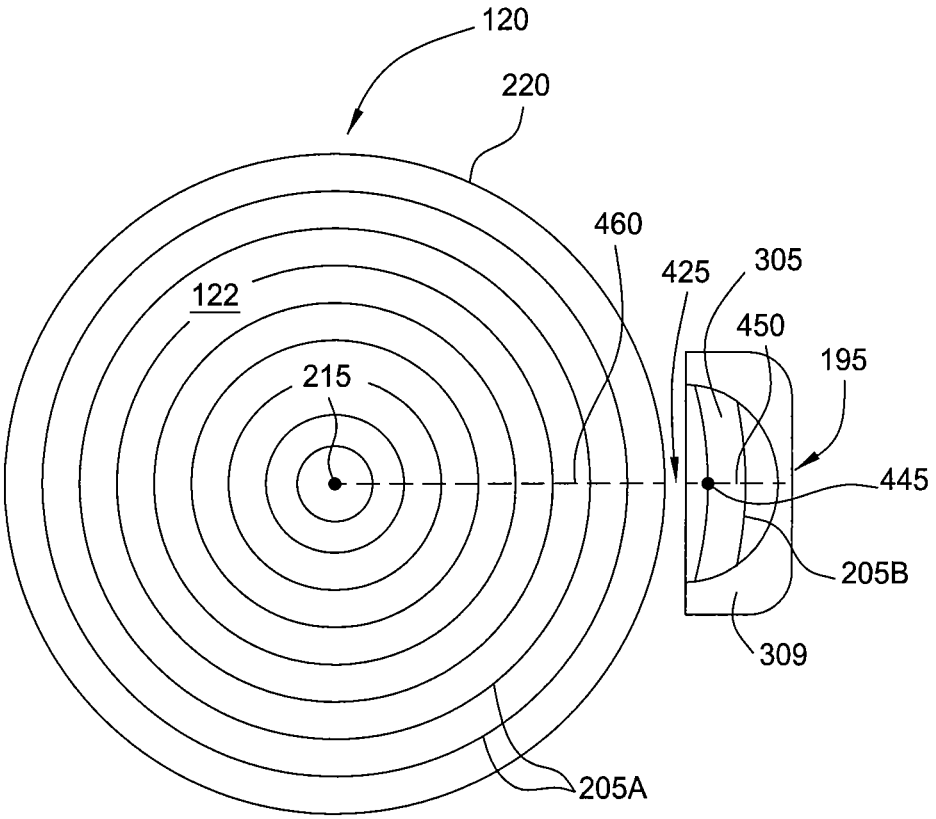
FIG. 4D is a top plan view of a polishing pad and a polishing surface extension device.

FIG. 4D is a top plan view of the polishing pad 120 and the polishing surface extension device 195. In this embodiment, alignment of the polishing surface extension device 195 relative to the polishing pad 120 is shown. The polishing pad 120 includes a radius 460 and the indexing feature 425 of the polishing surface extension device 195 is substantially aligned with the radius 460. In another aspect, the radius 450 and the center 445 of the sacrificial pad 305 may be substantially aligned with the radius 460 of the polishing pad 120.

Figure 5:
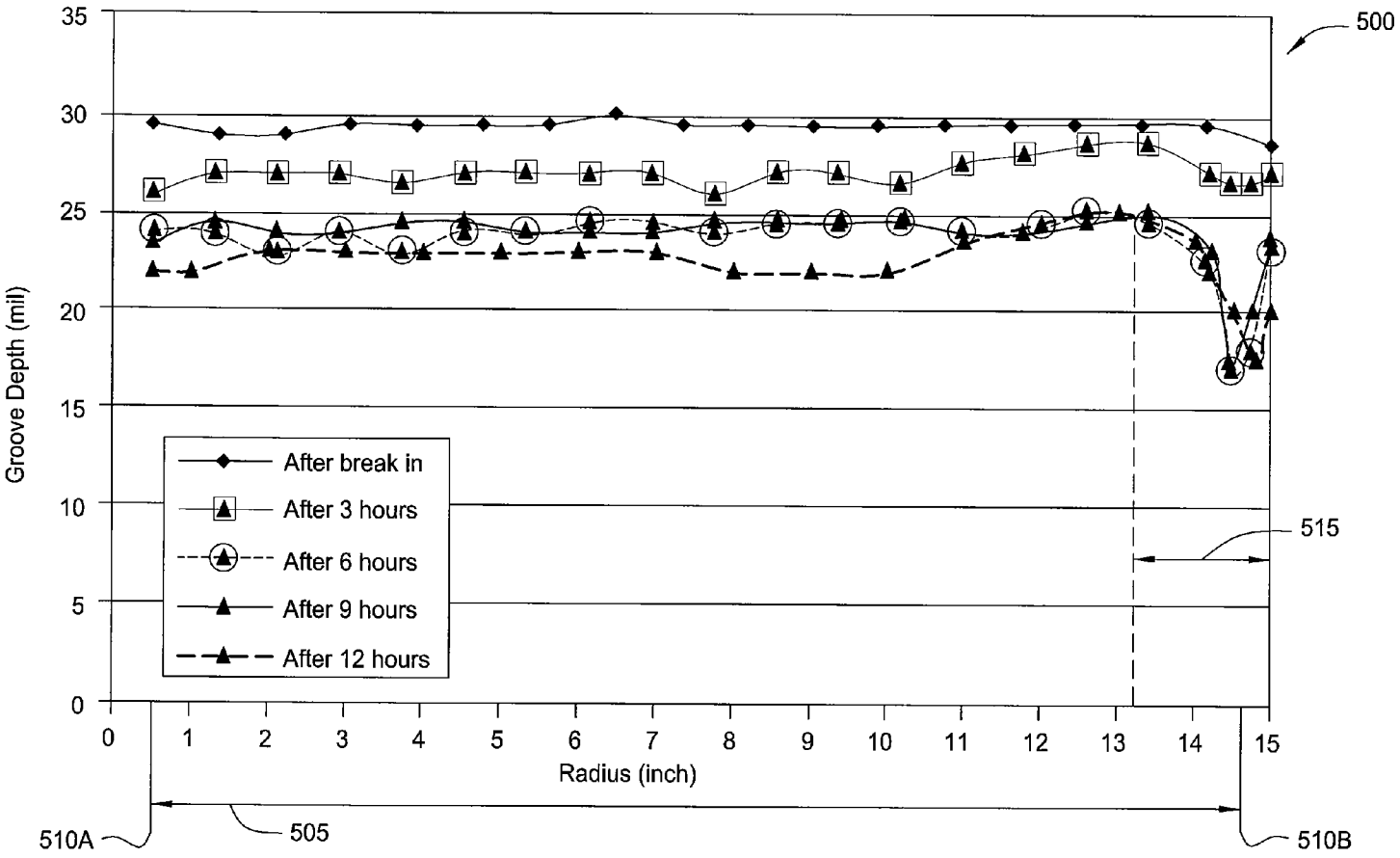
FIG. 5 is a graph showing test results indicating wear of a new (unused) polishing pad conditioned with a conventional conditioning apparatus and method.

FIG. 5 is a graph 500 showing test results of wear of a new (unused) polishing pad conditioned with a conventional conditioning apparatus and method. The polishing pad is similar to the polishing pad 120 described in FIGS. 1 and 2. The polishing pad exemplarily has a 30 inch diameter and grooves that are about 30 mils deep. The test was conducted using a diamond conditioning disk at a downforce of 7 pound-force. Reference numeral 505 represents a sweep range within a conditioning sweep pattern along the radius of the processing surface of the polishing pad. Each end 510A, 510B represents a radial location where a center of the conditioning element (i.e. center 215 of the conditioning element 190 shown in FIG. 2, for example) reaches a limit in the sweep range 505. The conditioning disk was rotated at about 60 RPM and the sweep frequency was about 20 cycles per minute. The ordinate plane represents a measurement of the groove depth in mils while the abscissa plane represents the radius of the polishing pad in inches.

The test was conducted using a break-in conditioning regime on the new polishing pad and a polishing process using the conditioned polishing pad. The polishing pad was continuously conditioned during the polishing process. The groove depths were measured at the increments shown to determine the magnitude of material that was removed from the processing surface by conditioning and/or polishing. As shown at the radial region indicated at 515, the outermost portion of the processing surface of the polishing pad was worn at a rate greater than the inner portion of the polishing pad. The greater wear at the outermost portion of the polishing pad significantly reduced the lifetime of the polishing pad.

Figure 6:
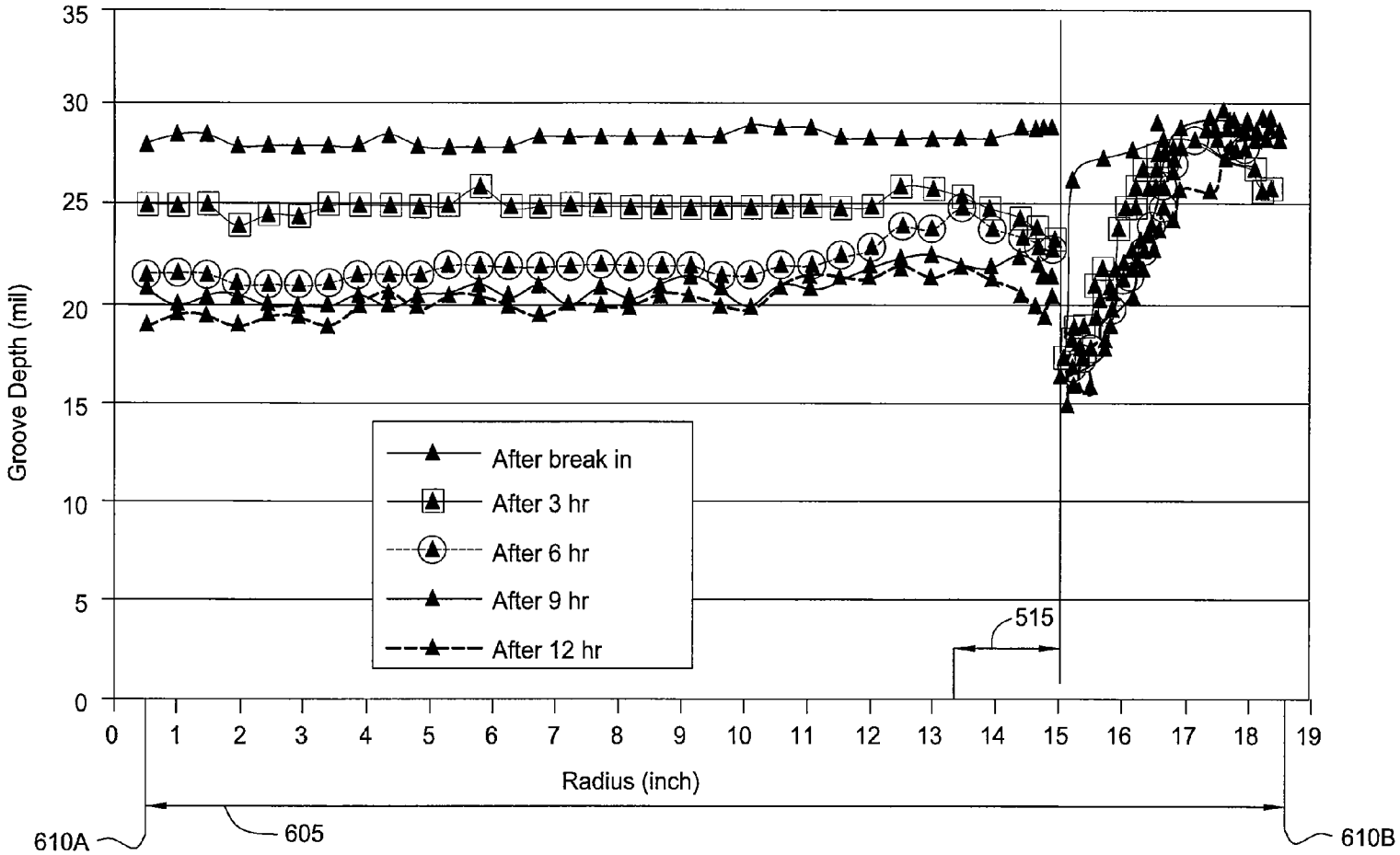
FIG. 6 is a graph showing test results indicating wear of a new (unused) polishing pad conditioned utilizing embodiments of the polishing surface extension device as described herein.

FIG. 6 is a graph 600 showing test results of wear of a new (unused) polishing pad conditioned with a polishing surface extension device 195 having a sacrificial pad 305 as described herein. The polishing pad is similar to the polishing pad 120 described in FIGS. 1 and 2. The polishing pad exemplarily has a 30 inch diameter and grooves that are about 30 mils deep. The test was conducted using a diamond conditioning disk at a downforce of 7 pound-force. Reference numeral 605 represents a sweep range within a conditioning sweep pattern (i.e. conditioning sweep pattern 210B as shown in FIG. 2) along the radius of the processing surface of the polishing pad. Each end 610A, 610B represents a radial location where a center of the conditioning element (i.e. center 215 of the conditioning element 190 shown in FIG. 2, for example) reaches a limit in the sweep range 505. The conditioning disk was rotated at about 60 RPM and the sweep frequency was about 20 cycles per minute. The ordinate plane represents a measurement of the groove depth in mils while the abscissa plane represents the radius of the polishing pad in inches.

The test was conducted using a break-in conditioning regime on the new polishing pad and a polishing process using the conditioned polishing pad. The polishing pad was continuously conditioned during the polishing process. The groove depths were measured at the increments shown to determine the magnitude of material that was removed from the processing surface by conditioning and/or polishing. As shown, wear of the processing surface was lessened or conditioned at the same rate at region 515 as the conditioning element was allowed to extend beyond the edge of the polishing pad. As shown, the lessened wear of the polishing pad at region 515 extended the lifetime of the polishing pad.

The embodiments described herein provide a method and apparatus for counteracting conditioning effects that may be detrimental to a polishing pad. The method and apparatus as described herein promotes a longer pad lifetime and facilitates a greater usable are of a polishing pad.

While the foregoing is directed to embodiments of the invention, other and further embodiments of the invention may be devised without departing from the basic scope thereof.

What is claimed is:

1. An apparatus, comprising:

a base having a rotatable polishing pad coupled to an upper surface thereof, the polishing pad having a polishing surface and a peripheral edge;

a carrier head adapted to retain a substrate;

a conditioning device adapted to move relative to the polishing surface in a sweep pattern that extends beyond the peripheral edge; and an extension device coupled to the base adjacent the peripheral edge of the polishing pad and adapted to support the conditioning device when the conditioning device in at least a portion of the sweep pattern, the extension device comprising:

a body that is movable relative to the polishing pad; and a sacrificial pad comprising a polishing material coupled to a mounting surface of the body, wherein one or both of the body and sacrificial pad includes an indexing feature.

2. The apparatus of claim 1, wherein the mounting surface has a surface area that is greater than a surface area of the sacrificial pad.

3. The apparatus of claim 1, wherein the indexing feature comprises a channel formed in the body.

4. The apparatus of claim 3, wherein the indexing feature comprises a notch disposed on the sacrificial pad that is aligned with the channel.

5. The apparatus of claim 1, wherein the body comprises an interface surface facing the peripheral edge of the polishing pad and is separated from the peripheral edge by a gap.

6. The apparatus of claim 5, wherein the interface surface is concave.

7. The apparatus of claim 6, wherein the polishing pad is circular and includes a radius and the interface surface comprises a radius that is substantially equal to the radius of the polishing pad.

8. The apparatus of claim 6, wherein the interface surface is planar.

9. The apparatus of claim 1, wherein both of the polishing pad and the sacrificial pad comprise a patterned surface.

10. The apparatus of claim 9, wherein the patterned surface is substantially the same on both of the polishing pad and the sacrificial pad.

11. The apparatus of claim 9, wherein both of the polishing pad and the sacrificial pad comprise one or more grooves.

12. The apparatus of claim 9, wherein the one or more grooves in each of the polishing pad and the sacrificial pad include a pitch that is substantially equal.

13. The apparatus of claim 12, wherein a distance between a peripheral groove of the polishing pad and one of the one or more grooves of the sacrificial pad is substantially equal to the pitch.

14. An apparatus, comprising:

a base having a rotatable platen and a circular polishing pad coupled to an upper surface thereof, the polishing pad having a polishing surface and a circumferential edge;

a carrier head adapted to retain a substrate;

a conditioning device adapted to move relative to the polishing surface in a sweep pattern that extends beyond the circumferential edge; and an extension device coupled to the base adjacent the circumferential edge of the polishing pad and adapted to support the conditioning device when the conditioning device in at least a portion of the sweep pattern, the extension device comprising:

a body that is movable relative to the polishing pad, the body having an interface surface facing the circumferential edge of the polishing pad;

a sacrificial pad comprising a polishing material coupled to a mounting surface of the body, the mounting surface having a surface area that is greater than a surface area of the sacrificial pad; and an indexing feature disposed on one or both of the body and the sacrificial pad to facilitate alignment of the sacrificial pad and the mounting surface.

15. The apparatus of claim 14, wherein the indexing feature comprises a channel formed in the body.

16. The apparatus of claim 15, wherein the indexing feature disposed on the sacrificial pad comprises a channel that is aligned with the channel formed in the body.

17. The apparatus of claim 14, wherein the interface surface is concave.

18. The apparatus of claim 17, wherein the interface surface comprises a radius that is substantially equal to a radius of the polishing pad.

19. A method for conditioning a polishing pad, comprising:

urging a conditioning disk against a polishing surface of a rotating polishing pad, the conditioning disk having a contact surface with a first surface area; and moving the conditioning disk while in contact with the polishing surface in a sweep pattern that extends beyond a peripheral edge of the polishing pad and at least partially onto a sacrificial pad adjacent the peripheral edge of the polishing pad, the sacrificial pad having a second surface area that is less than the first surface area of the contact surface of the conditioning disk.

20. The method of claim 19, wherein a substantially equal downforce is applied to the conditioning disk and maintained across the sweep pattern.

21. The method of claim 19, wherein the sacrificial pad is separated from the polishing pad by a gap.

22. The method of claim 19, wherein the conditioning comprises removing material from the polishing pad and the sacrificial pad at substantially the same rate.

* * * * *